US008943799B2

(12) United States Patent
Sasaki

(10) Patent No.: US 8,943,799 B2
(45) Date of Patent: Feb. 3, 2015

(54) CONTROL DEVICE FOR INTERNAL COMBUSTION ENGINE

(75) Inventor: Takanori Sasaki, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 58 days.

(21) Appl. No.: 13/884,983

(22) PCT Filed: Jan. 21, 2011

(86) PCT No.: PCT/JP2011/051086

§ 371 (c)(1),
(2), (4) Date: May 13, 2013

(87) PCT Pub. No.: WO2012/098674

PCT Pub. Date: Jul. 26, 2012

(65) Prior Publication Data

US 2013/0291521 A1 Nov. 7, 2013

(51) Int. Cl.

| | |
|---|---|
| ***F01N 11/00*** | (2006.01) |
| ***F02D 41/14*** | (2006.01) |
| *F02D 41/24* | (2006.01) |

(52) U.S. Cl.

CPC ..... *F01N 11/00* (2013.01); *F02D 41/1454* (2013.01); *F02D 41/2454* (2013.01); *F02D 41/2474* (2013.01); *F02D 2200/0816* (2013.01)

USPC ..... 60/276; 60/277; 73/114.71; 73/114.73; 73/114.75; 204/424; 205/784.5; 205/785

(58) Field of Classification Search

USPC ..... 60/276, 277; 73/114.71, 114.73, 73/114.75; 204/424; 205/784.5, 785; 422/83

See application file for complete search history.

(56) References Cited

FOREIGN PATENT DOCUMENTS

| | | |
|---|---|---|
| JP | A-11-247687 | 9/1999 |
| JP | A-2008-256707 | 10/2008 |
| JP | A-2009-180669 | 8/2009 |
| JP | A-2010-127091 | 6/2010 |
| JP | A-2010-276530 | 12/2010 |
| WO | WO 2010/136859 A1 | 12/2010 |

*Primary Examiner* — Kenneth Bomberg
*Assistant Examiner* — Brandon Lee
(74) *Attorney, Agent, or Firm* — Oliff PLC

(57) ABSTRACT

In a control device for an internal combustion engine including an air-fuel ratio sensor that includes a catalyst layer that covers an exhaust gas-side electrode, an oxygen storage capacity of the catalyst layer is acquired based on a sensor output of the air-fuel ratio sensor. The sensor output is corrected if the oxygen storage capacity is higher than a predetermined value and the sensor output is in a predetermined range in the vicinity of the theoretical air-fuel ratio. Preferably, the oxygen storage capacity is calculated by integrating the product of a deviation amount ΔA/F of the sensor output with respect to the theoretical air-fuel ratio and a dwell time thereof. A correction period in which a correction operation is performed is set based on the oxygen storage capacity.

6 Claims, 6 Drawing Sheets

CONTROL DEVICE FOR INTERNAL COMBUSTION ENGINE

TECHNICAL FIELD

The present invention relates to a control device for an internal combustion engine, and more particularly to a control device for an internal combustion engine that has an exhaust gas sensor in which an exhaust gas-side electrode of a sensor element is covered with a catalyst layer.

BACKGROUND ART

An air-fuel ratio control device has already been proposed that is equipped with an $O_2$ sensor in which an exhaust gas-side electrode of a sensor element is covered with a catalyst layer, as disclosed, for example, in Japanese Patent Laid-Open No. 11-247687. In the air-fuel ratio control device, the exhaust gas-side electrode is formed on a surface of the sensor element of the $O_2$ sensor, and the exhaust gas-side electrode is covered by a catalyst, layer that removes hydrogen by a catalytic reaction.

In an $O_2$ sensor which does not include a catalyst layer, oxygen ($O_2$) and hydrogen ($H_2$) cause an oxidation reaction at an exhaust gas-side electrode. At this time, since $H_2$ has a higher rate of gas diffusion than $O_2$, $H_2$ is more widely diffused than $O_2$. Consequently, even if the exhaust gas components are in a stoichiometric ratio, a $H_2$-rich atmosphere is generated in the vicinity of the electrode. In such case, since the output of the $O_2$ sensor does not change suddenly unless the components of the exhaust gas become leaner than the stoichiometric ratio, the relationship between the air purification rata and the sensor output shifts to the lean side.

In the above described $O_2$ sensor that includes a catalyst layer, since $O_2$ and $H_2$ react in the catalyst layer and arrive at the exhaust gas-side electrode as an equilibrium gas, it is possible to suppress the occurrence of a situation in which the sensor output shifts to the lean side.

PRIOR ART DOCUMENTS

Patent Documents

Patent Document 1: Japanese Patent Laid-Open No. 11-247687

Patent Document 2; Japanese Patent Laid-Open No. 2009-180669

SUMMARY OF INVENTION

Problem to be Solved by the Invention

In a limiting-current-type exhaust gas sensor in which a catalyst layer is provided, the detection accuracy is extremely high and the robustness at a time of engine control is also high, and hence precise air-fuel ratio control can be performed. However, on the other hand, when the sensor output straddles the theoretical air-fuel ratio (stoichiometric ratio) to transition from lean to rich or from rich to lean, in some cases a phenomenon occurs whereby the sensor output stagnates in the vicinity of the theoretical air-fuel ratio. This situation is attributable to a phenomenon whereby an OSC material such as ceria that is included in the catalyst layer stores oxygen under a lean atmosphere and releases oxygen under a rich atmosphere, or a phenomenon whereby a noble metal included in the catalyst layer oxidizes under a lean atmosphere and is reduced under a rich atmosphere. Accordingly, when air-fuel ratio control is executed based on this kind of sensor output, there is a risk that emissions or OBD will be adversely affected.

The present invention has been conceived to solve the above described problems, and an object of the present invention is to provide a control device for an internal combustion engine that can effectively correct an output deviation in the vicinity of a theoretical air-fuel ratio in an exhaust gas sensor in which an exhaust gas-side electrode of a sensor element is covered with a catalyst layer.

Means for Solving the Problem

In accomplishing the above object, according to a first aspect of the present invention, there is provided a control device for an internal combustion engine, comprising:

an exhaust gas sensor that is arranged in an exhaust passage of an internal combustion engine, and includes a sensor element comprising a solid electrolyte in which an atmosphere-side electrode is formed on one side surface and an exhaust gas-side electrode is formed on another side surface, and a catalyst layer that covers the exhaust gas-side electrode;

oxygen storage capacity acquisition means that, based on a sensor output, of the exhaust gas sensor, acquires an oxygen storage capacity that represents a capacity of the catalyst layer to store or release oxygen; and correction means that, when the oxygen storage capacity is higher than a predetermined value and the sensor output is in a predetermined range in a vicinity of a theoretical air-fuel ratio, executes a correction operation that corrects the sensor output.

According to a second aspect of the present invention, there is provided the control device for an internal combustion engine as described in the first aspect, wherein, as the oxygen storage capacity, the oxygen storage capacity acquisition means acquires a value obtained by integrating a product of a deviation amount, of the sensor output with respect to a theoretical air-fuel ratio and a dwell time thereof.

According to a third aspect of the present invention, there is provided the control device for an internal combustion engine as described in the first or second aspect, further comprising:

sensor output rate-of-change acquisition means that acquires a rate of change of the sensor output, wherein the correction means executes the correction operation when the oxygen storage capacity is higher than a predetermined value, the sensor output is in a predetermined range in a vicinity of a theoretical air-fuel ratio, and a rate of change in the sensor output is less than a predetermined value.

According to a fourth aspect of the present invention, there is provided the control device for an internal combustion engine as described in any one of the first to third aspects, further comprising setting means that sets a correction period in which the correction operation is performed, in accordance with the oxygen storage capacity.

According to a fifth aspect of the present invention, there is provided the control device for an internal combustion engine as described in any one of the first to fourth aspects, further comprising:

a heater for heating the sensor element to a predetermined activation temperature; and heating control means that, when executing the correction operation, controls the heater so that the sensor element becomes a higher temperature than the predetermined activation temperature.

According to a sixth aspect, of the present invention, there is provided the control device for an internal combustion engine as described in any one of the first to fifth aspects, further comprising:

setting means that sets a correction period in which the correction operation is performed, in accordance with the oxygen storage capacity;

output stagnation time period acquisition means that acquires an output stagnation time period from a time that the correction operation starts until a time that the sensor output tracks an actual air-fuel ratio change; and deterioration determination means that, when the correction period is longer than the output stagnation time period, determines that there is deterioration of the catalyst layer in the exhaust gas sensor.

Effects of the Invention

According to the first invention, a sensor output is corrected in a case where an oxygen storage capacity of a catalyst layer that is calculated based on the sensor output is higher than a predetermined value and the sensor-output is within a predetermined range in the vicinity of the stoichiometric ratio. Therefore, according to the present invention, since the timing at which the sensor output begins to stagnate can be effectively identified and a correction operation can be executed, the occurrence of a situation in which a sensor output in which an output deviation has arisen is used can be effectively suppressed.

According to the second invention, an oxygen storage capacity is calculated as a sum total of the product of a deviation amount of a sensor output with respect to a theoretical air-fuel ratio and a dwell time thereof. Therefore, according to the present invention, a value in which the capacity of the catalyst layer to store or release oxygen is effectively reflected can be calculated as the oxygen storage capacity.

According to the third invention, a sensor output is corrected in a case where, in addition to when an oxygen storage capacity of a catalyst layer that is calculated based on the sensor output is higher than a predetermined value and the sensor output is within a predetermined range in the vicinity of the stoichiometric ratio, a rate of change in the sensor output is also less than, a predetermined value. Therefore, according to the present invention, a timing at which the sensor output begins to stagnate can be identified with even higher accuracy.

According to the fourth invention, a correction period in which a correction operation is performed is set in accordance with the oxygen storage capacity of the catalyst layer. The larger that the oxygen storage capacity is, the longer that a stagnation time period of the sensor output tends to be. Therefore, according to the present invention, the timing at which to end a correction operation with respect to the sensor output can be effectively determined based on the oxygen storage capacity.

According to the fifth invention, when executing correction of the sensor output of an exhaust gas sensor, the exhaust gas sensor element is heated to a higher temperature than a predetermined activation temperature. Consequently, according to the present invention, since the sensor activity can be enhanced when correcting the sensor output of the exhaust gas sensor, recovery from a state of output stagnation can be achieved at an early stage.

According to the sixth invention, when a correction period in which a correction operation is performed that was set based on the oxygen storage capacity of the catalyst layer is longer than the actual period in which the sensor output stagnated in the vicinity of the stoichiometric ratio, it means that the actual oxygen storage capacity is lower than the calculated value. Therefore, according to the present invention, deterioration of the exhaust gas sensor can be effectively determined based on the relationship between a correction period in which a correction operation is performed and an output stagnation time period.

MODES FOR CARRYING OUT THE INVENTION

Hereunder, embodiments of the present invention are described based on the attached drawings. Mote that elements that are common to the respective drawings are denoted by the same reference symbols, and a duplicate description thereof is omitted. Further, the present invention is not limited by the following embodiments.

Embodiment 1

[Configuration of Embodiment 1]

Figure 1:
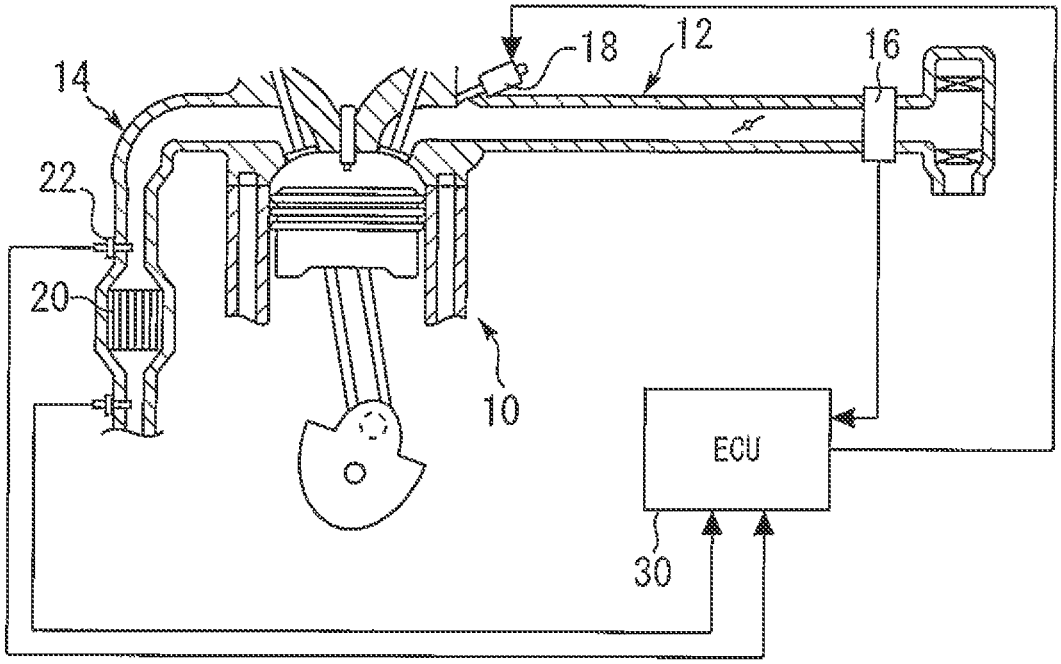
FIG. 1 is a view for describing a hardware configuration of Embodiment 1 of the present invention.

FIG. 1 is a view for describing a hardware configuration of Embodiment 1 of the present invention. As shown in FIG. 1, a system of the present embodiment includes an internal combustion engine 10. In the internal combustion engine 10, an intake passage 12 and an exhaust passage 14 communicate with each other. An air flow meter 16 that detects an intake air amount Ga is arranged in the intake passage 12. An injector 18 for injecting fuel into an intake port is arranged in each cylinder of the internal combustion engine 10.

An exhaust purification catalyst 20 (hereunder, also referred to as simply "catalyst") is arranged in the exhaust passage 14 of the internal combustion engine 10. The catalyst 20 is a three-way catalyst, and simultaneously removes CO, HC (hydrocarbon) and NOx, which are harmful components contained in exhaust gas, in the vicinity of the theoretical air-fuel ratio.

An air-fuel ratio sensor (A/F sensor) 22 with a catalyst is arranged on the upstream side of the catalyst 20 in the exhaust passage 14. The air-fuel ratio sensor 22 linearly detects an oxygen concentration contained in exhaust gas, and detects an air-fuel ratio of an air-fuel mixture combusted in the internal combustion engine 10 based on an oxygen concentration in exhaust gas that flows into the catalyst 20. The configuration of the air-fuel ratio sensor 22 is described in detail later.

The apparatus of the present embodiment includes an ECU (Electronic Control Unit) 30. Various sensors such as the above described air-fuel ratio sensor 22 and the injector 18 and the like are connected to the ECU 30. The ECU 30 controls the operating state of the internal combustion engine 10 based on the outputs of the sensors.

[Configuration of Air-Fuel Ratio Sensor]

Figure 2:
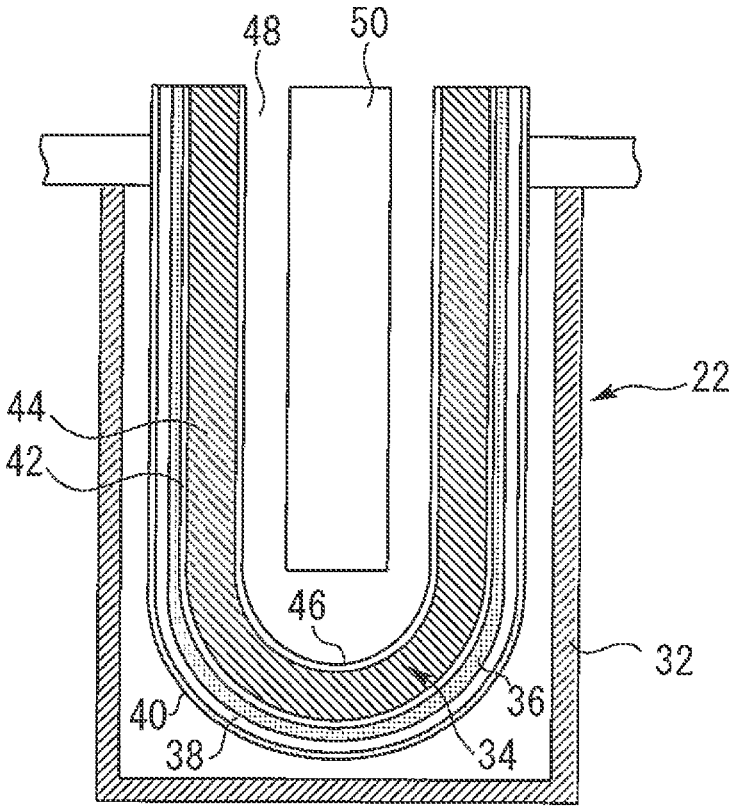
FIG. 2 is a view for describing the configuration of the air-fuel ratio sensor used in Embodiment 1 of the present invention.

FIG. 2 is a view for describing the configuration of the air-fuel ratio sensor 22 used in Embodiment 1 of the present invention. As described above, the air-fuel ratio sensor 22 shown in FIG. 2 is arranged in the exhaust passage 14 of the internal combustion engine 10. The air-fuel ratio sensor 22 is used for detecting, on the upstream side of the catalyst 20, an air-fuel ratio of exhaust gas that is to be discharged from the internal combustion engine 10. The air-fuel ratio sensor 22 includes a cover 32. The cover 32 is installed in the exhaust passage 14 so as to be exposed to exhaust gas.

A hole (not shown) for guiding exhaust gas into the inside of the cover 32 is formed in the cover 32. A sensor element 34 is arranged inside the cover 32. The sensor element 34 has a tubular structure in which one end (the lower end in FIG. 2) is closed. The external surface of the tubular structure is covered with a diffusion resistance layer 36. The diffusion resistance layer 36 is a heat-resistant porous material such as alumina, and has an action that regulates a rate of diffusion of exhaust gas in the vicinity of the surface of the sensor element 34.

The external surface of the diffusion resistance layer 36 is covered with a catalyst layer 38. In the catalyst layer 38, a catalytic metal such as platinum and rhodium is carried on a base material such as alumina. The catalyst layer 38 is covered with a protective layer 40 for protecting the catalyst layer 38. The protective layer 40 is constituted by a heat-resistant porous material such as alumina.

An exhaust gas-side electrode 42, a solid electrolyte layer 44 and an atmosphere-side electrode 46 are provided inside the diffusion resistance layer 36. The exhaust gas-side electrode 42 and the atmosphere-side electrode 46 are composed of a highly catalytic noble metal such as Pt, and are each electrically connected to a control circuit that is described later. The solid electrolyte layer 44 is a sintered body containing $ZrO_2$ or the like, and permits the conduction of oxygen ions.

An atmospheric chamber 48 that is opened to the atmosphere is formed inside the sensor element 34. A heater 50 for heating the sensor element 34 is arranged in the atmospheric chamber 48. The sensor element 34 exhibits a stable output characteristic at an activation temperature of approximately 400° C. The heater 50 is electrically connected to a control circuit, and is capable of heating the sensor element 34 to a suitable temperature and maintaining the sensor element 34 at that temperature.

[Operations of Embodiment 1]

Feedback control of an air-fuel ratio is performed in the internal combustion engine 10 of the present embodiment. More specifically, based on an output signal of the air-fuel ratio sensor 22, main feedback control is performed that controls a fuel injection amount that is injected from each injector 18 so that the actual air-fuel ratio matches a target air-fuel ratio. If the main feedback control is performed normally, the actual air-fuel ratio can always be controlled in the vicinity of the target air-fuel ratio, and a deterioration in emissions can be effectively suppressed.

In this case, in an air-fuel ratio sensor that does not include a catalyst layer, oxygen ($O_2$) and hydrogen ($H_2$) diffuse inside the diffusion resistance layer and cause an oxidation reaction at an exhaust gas-side electrode. At this time, because hydrogen has a higher rate of gas diffusion than oxygen, the hydrogen diffuses more widely than the oxygen. Consequently, even if the exhaust gas components are in a stoichiometric ratio, a hydrogen-rich atmosphere is generated in the vicinity of the electrode. In such case, since the output of the air-fuel ratio sensor deviates to the rich output side, the air-fuel ratio also deviates to the rich side.

In the above described air-fuel ratio sensor 22 equipped with the catalyst layer 38, oxygen and hydrogen react in the catalyst layer 38 and reach the exhaust gas-side electrode 42 as an equilibrium gas. Consequently, the occurrence of a situation in which the sensor output erroneously deviates to the rich output side can be suppressed.

Figure 3:
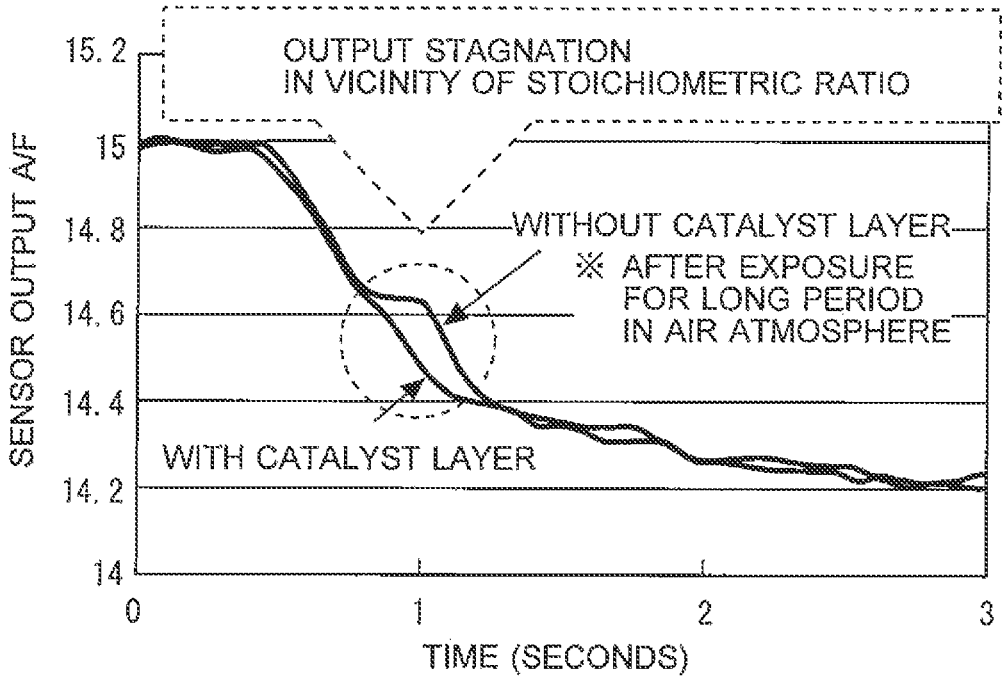
FIG. 3 is a view in which the sensor output, of the air-fuel ratio sensor equipped with a catalyst layer and an air-fuel ratio sensor that is not equipped with a catalyst layer are compared.

However, in the air-fuel ratio sensor 22 equipped with the catalyst layer 38, there is a potential problem with respect to the sensor output in the vicinity of the theoretical air-fuel ratio (stoichiometric ratio). FIG. 3 is a view in which the sensor output of the air-fuel ratio sensor equipped with a catalyst layer and an air-fuel ratio sensor that is not equipped with a catalyst layer are compared. As shown in FIG. 3, in the case of the air-fuel ratio sensor equipped with the catalyst layer, when the sensor output straddles the theoretical air-fuel ratio (stoichiometric ratio) to transition from lean to rich, the sensor output stagnates temporarily in the vicinity of the theoretical air-fuel ratio. This is because an OSC material such as ceria that is included in the catalyst layer 38 stores oxygen under a lean atmosphere and releases oxygen under a rich atmosphere, or because a noble metal oxidized under a lean atmosphere is reduced under a rich atmosphere. When air-fuel ratio control is executed based on this sensor output, there is a risk that emissions or OBD will be adversely affected.

Figure 4:
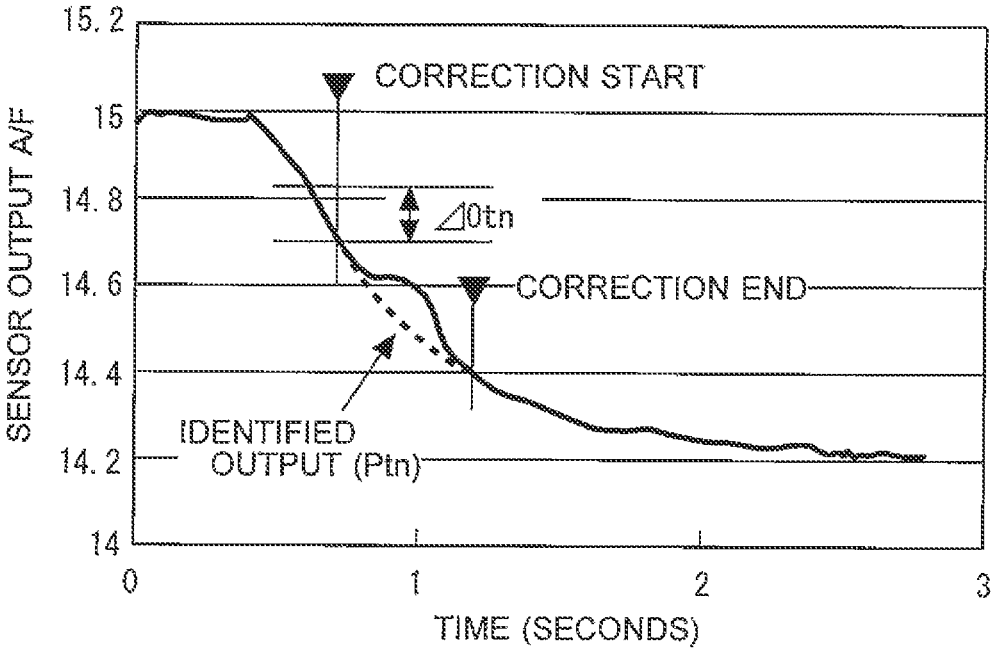
FIG. 4 is a view for describing a method of correcting the sensor output.

Therefore, in the system of the present embodiment, a configuration is adopted that corrects a sensor output when the sensor output stagnates in the vicinity of the stoichiometric ratio. FIG. 4 is a view for describing a method of correcting the sensor output. Note that, although in the description hereunder, as shown in FIG. 4, an example is described in which the sensor output-straddles the stoichiometric ratio to transition from lean to rich, in a case where the sensor output straddles the stoichiometric ratio to transition from rich to lean, it is sufficient to execute control in the same manner as described hereunder with the exception that the terms "rich" and "lean" are interchanged with each other.

In order to correct stagnation of the sensor output in the vicinity of the stoichiometric ratio, first, it is necessary to identify the timing at which the sensor output begins to stagnate. As described above, stagnation of the sensor output in the vicinity of the stoichiometric ratio occurs in a case where the catalyst layer 38 stores oxygen, in other words, when noble metal in the catalyst layer 38 is oxidised. The degree of oxidation of the noble metal is influenced by the degree of leanness of the atmosphere to which the catalyst layer 38 is exposed and the dwell time. Therefore, according to the system of the present embodiment, as an amount that represents the oxygen storage level (oxygen release level in a rich atmosphere) of the catalyst layer 38, an integrated value of the product of a deviation amount $\Delta A/F$ of the sensor output from the theoretical air-fuel ratio and the dwell time thereof is defined as an oxygen storage capacity, and the oxygen storage capacity is used, as an index for determining whether or not stagnation of the sensor output occurs. More specifically, for example, a time when the sensor output changed from lean to the vicinity of the stoichiometric ratio in a state where the oxygen storage capacity of the catalyst layer 38 is greater than or equal to a predetermined value can be identified as the timing at which the sensor output begins to stagnate.

Further, a configuration may also be adopted in which, when identifying the timing at which stagnation of the sensor output starts, in addition to determination by means of the aforementioned oxygen storage capacity, it is also determined whether or not a rate of output change in a sensor output Otn has become less than a predetermined value. Furthermore, a configuration may be adopted in which, in the aforementioned determination, an output-change amount $\Delta Ot_n$(=Otn−Otn−1) in a predetermined period of the sensor output Otn that is a correlation value of the rate of output change, or a change ratio (=ΔOtn/ΔOtn−1) of the output change amount ΔOtn is used for the determination. It is thereby possible to identify the timing at which stagnation of the sensor output starts with even greater accuracy.

Correction of the sensor output Otn is executed after the timing at which stagnation of the sensor output starts is identified. As the correction method, for example, an actual change in the air-fuel ratio is identified based on the sensor output up to the timing at which stagnation of the sensor output starts, and the actual change in the air-fuel ratio can be used as an identified output Ptn.

If the sensor output has inverted (that is, has begun to change towards the rich direction) during execution of the above described correction operation, or if the output change amount ΔOtn has become larger than a predetermined value, it can be determined that stagnation of the sensor output ended. Therefore, when such kind of sensor output is detected while executing the correction operation, it is preferable to end the correction operation and switch from the identified output Ptn to the sensor output Otn. It is thereby possible to effectively avoid a situation in which unnecessary correction is continued. Thus, according to the system of the present embodiment, stagnation of a sensor output in the vicinity of the stoichiometric ratio can be effectively corrected.

[Specific Processing in Embodiment 1]

Figure 5:
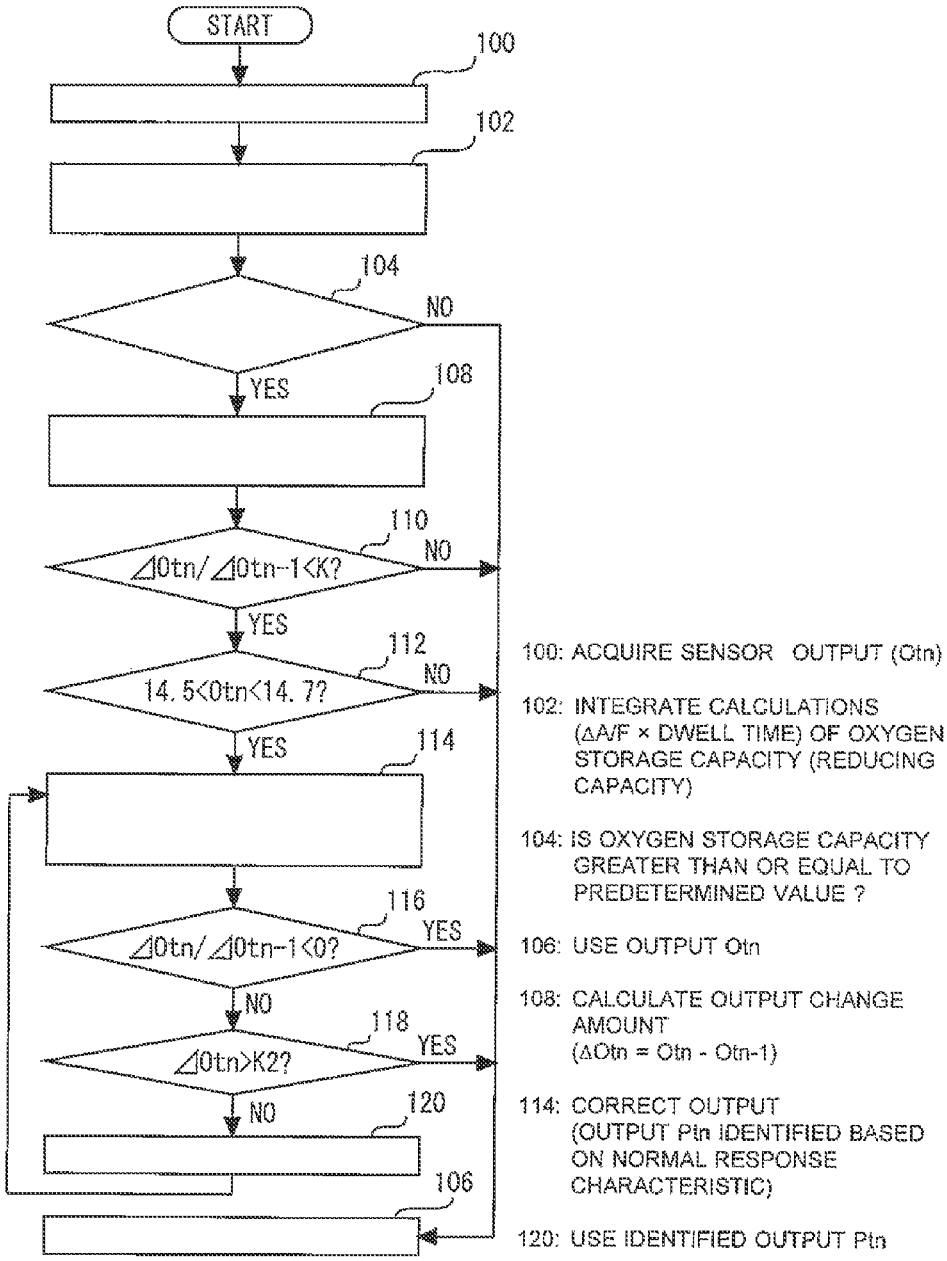
FIG. 5 is a flowchart of a routine that the ECU executes according to Embodiment 1.

Next, specific processing of Embodiment 1 of the present invention is described with reference to FIG. 5. FIG. 5 is a flowchart of a routine that the ECU 30 executes according to Embodiment 1. According to the routine shown in FIG. 5, first, the ECU 30 acquires the sensor output Otn (air-fuel ratio) of the air-fuel ratio sensor 22 (step 100). Next, the ECU 30 calculates the oxygen storage capacity of the catalyst layer 38 (step 102). In this case, specifically, during a period in which the air-fuel ratio is lean or is rich, products of a deviation amount ΔA/F from the theoretical air-fuel ratio of the sensor output Otn and the dwell time thereof are integrated, and the integrated value is calculated as an oxygen storage capacity.

Next, the ECU 30 determines whether or not the oxygen storage capacity is greater than or equal to a predetermined value (step 104). As the predetermined value, a value is used that is previously set as a value that indicates that oxygen of a level such that stagnation of the sensor output occurs in the vicinity of the stoichiometric ratio is stored in the catalyst layer 38. If the result determined in step 104 is that the condition that the oxygen storage capacity≥predetermined value is not established, the ECU 30 determines that stagnation of the sensor output does not occur even if the sensor output is in the vicinity of the stoichiometric ratio, and moves to the next step to use the sensor output Otn for air-fuel ratio control (step 106).

In contrast, if it is determined in the aforementioned step 104 that the condition that, the oxygen storage capacity≥predetermined value is established, the ECU 30 determines that oxygen of a level such that stagnation of the sensor output occurs is stored in the catalyst layer 38, and moves to the next step to calculate the output change amount ΔOtn (=Otn−Otn−1) in a predetermined period of the sensor output (step 108).

Next, the ECU 30 determines whether or not (ΔOtn/ΔOtn−1) that shows a change ratio of the output change amount ΔOtn is smaller than a predetermined value K (step 110). When the change ratio of the output change amount ΔOtn is small, it indicates that a change in the sensor output Otn is slow. In this case, specifically, the size relationship between (ΔOtn/ΔOtn−1) and the predetermined value K is compared. If it is determined as a result that the condition (ΔOtn/ΔOtn−1)<K is not established, the ECU 30 determines that a change in the sensor output has not yet become slow, and moves to the aforementioned step 106 to continue to use the sensor output Otn for air-fuel ratio control.

In contrast, in the aforementioned step 110, if it IS determined that the condition (ΔOtn/ΔOtn−1)<K is established, the ECU 30 determines that a change in the sensor output has become slow, and moves to the next step to determine whether or not the sensor output Otn is an air-fuel ratio in the vicinity of the stoichiometric ratio (step 112). If it is determined as a result that the condition 14.5<Otn<14.7 is not established, the ECU 30 determines that the air-fuel ratio is not in a region in which stagnation of the sensor output arises, and moves to the aforementioned step 106 to continue to use the sensor output Otn for air-fuel ratio control.

In contrast, in the aforementioned step 112, if it is determined that the condition 14.5<Otn<14.7 is established, the ECU 30 determines that stagnation of the sensor output in the vicinity of the stoichiometric ratio is occurring, and moves to the next step in which the sensor output Otn is corrected to the identified output Ptn (step 114). Here, specifically, the ECU 30 identifies a change in the actual air-fuel ratio in the vicinity of the stoichiometric ratio based on the sensor output up to a time immediately prior to executing the output correction, and calculates an output that corresponds thereto as the identified output Ptn.

Next, the ECU 30 determines whether or not the sensor output has turned from a change to the rich side to a change to the lean side (step 116). In this case, specifically, the ECU 30 determines whether the condition ΔOtn/ΔOtn−1<0 is established. If it is determined as a result that the condition ΔOtn/ΔOtn−1<0 is established, since it indicates that the sensor output has begun to change towards the lean side, the ECU 30 determines that correction of the sensor output should be ended. In this case, the ECU 30 moves to the aforementioned step 106 to again use the sensor output Otn for air-fuel ratio control instead of the identified output Ptn.

In contrast, in the aforementioned step 116, if it is determined that the condition ΔOtn/ΔOtn−1<0 is not established, the ECU 30 moves to the next step to determine whether or not the output change amount ΔOtn is greater than, a predetermined value K2 (step 118). As the predetermined value K2, a value is used that is previously set as a value that indicates that stagnation of the sensor output has been eliminated. If it is determined as a result that the condition ΔOtn>K2 is established, the ECU 30 determines that the sensor output has begun to change, and moves to the aforementioned step 106 to again use the sensor output Otn for air-fuel ratio control instead of the identified output Ptn. In contrast, in the aforementioned step 118, if it is determined that the condition ΔOtn>K2 is not established, the ECU 30 determines that the sensor output, is still stagnating, and therefore moves to the next step in which the identified output Ptn is used for air-fuel ratio control as a corrected air-fuel ratio (step 120).

As described above, according to the system of the present embodiment, when the sensor output Otn has stagnated in the vicinity of the stoichiometric ratio, the sensor output can be effectively corrected using the identified output Ptn.

In this connection, in the above described Embodiment 1, although a configuration is adopted that corrects the sensor output in a case where the oxygen storage capacity is equal to or greater than a predetermined value, the sensor output is in the vicinity of the stoichiometric ratio, and the change ratio ($\Delta Otn/\Delta Otn-1$) of the output change amount $\Delta Otn$ is smaller than the predetermined value K, the condition regarding the change ratio of the output change amount $\Delta Otn$ is not required as long as there is the condition regarding the oxygen storage capacity. Further, instead of the change ratio ($\Delta Otn/\Delta Otn-1$) of the output change amount $\Delta Otn$, the rate of output change may be used as an index that indicates that a change in the sensor output Otn has become slow.

Note that, in the above described Embodiment 1, "oxygen storage capacity acquisition means" according to the above described first invention is realized by the ECU 30 executing the processing in the aforementioned step 102, and "correction means" according to the first invention is realized by the ECU 30 executing the processing in the aforementioned step 114.

Further, in the above described Embodiment 1, "sensor output rate-of-change acquisition means" according to the above described third invention is realized by the ECU 30 executing the processing in the aforementioned step 108, and "correction means" according to the third invention is realized, by the ECU 30 executing the processing in the aforementioned step 114.

Embodiment 2

[Features of Embodiment 2]

Next, Embodiment 2 of the present invention is described with reference to FIG. 6 and FIG. 7. The system of the present embodiment can be implemented using the hardware configuration shown in FIG. 1 by causing the ECU 30 to execute a routine that is shown in FIG. 7 that is described later.

A feature according to Embodiment 2 is that a correction period in which correction of the sensor output is executed is set in accordance with the oxygen storage capacity. That is, as described above in Embodiment 1, the oxygen storage capacity changes depending on the exhaust gas atmosphere (air-fuel ratio) and the dwell time thereof. FIG. 6 is a view that illustrates the relationship of the oxygen storage capacity with respect to an integrated value of $\Delta A/F\times$dwell time. As shown in FIG. 6, the oxygen storage capacity increases approximately proportionally with the integrated value of $\Delta A/F\times$dwell time until the catalyst layer 38 saturates with oxygen. In this case, stagnation of the sensor output in the vicinity of the stoichiometric ratio is an output characteristic that arises due to oxygen stored in the catalyst layer 38 reacting with exhaust gas under a lean atmosphere. Consequently, as shown in FIG. 6, similarly to the oxygen storage capacity of the catalyst layer 38, an output stagnation time period of the sensor output increases approximately proportionally with the integrated value of $\Delta A/F\times$dwell time until the catalyst layer 38 saturates with oxygen.

Figure 6:
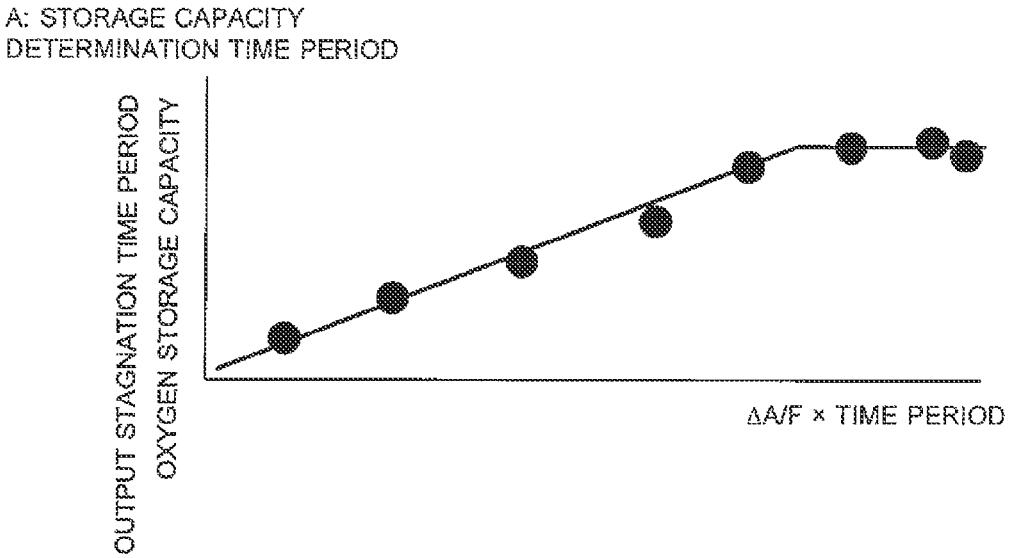
FIG. 6 is a view that illustrates the relationship of the oxygen storage capacity with respect to an integrated value of $\Delta A/F \times$dwell time.
Figure 7:
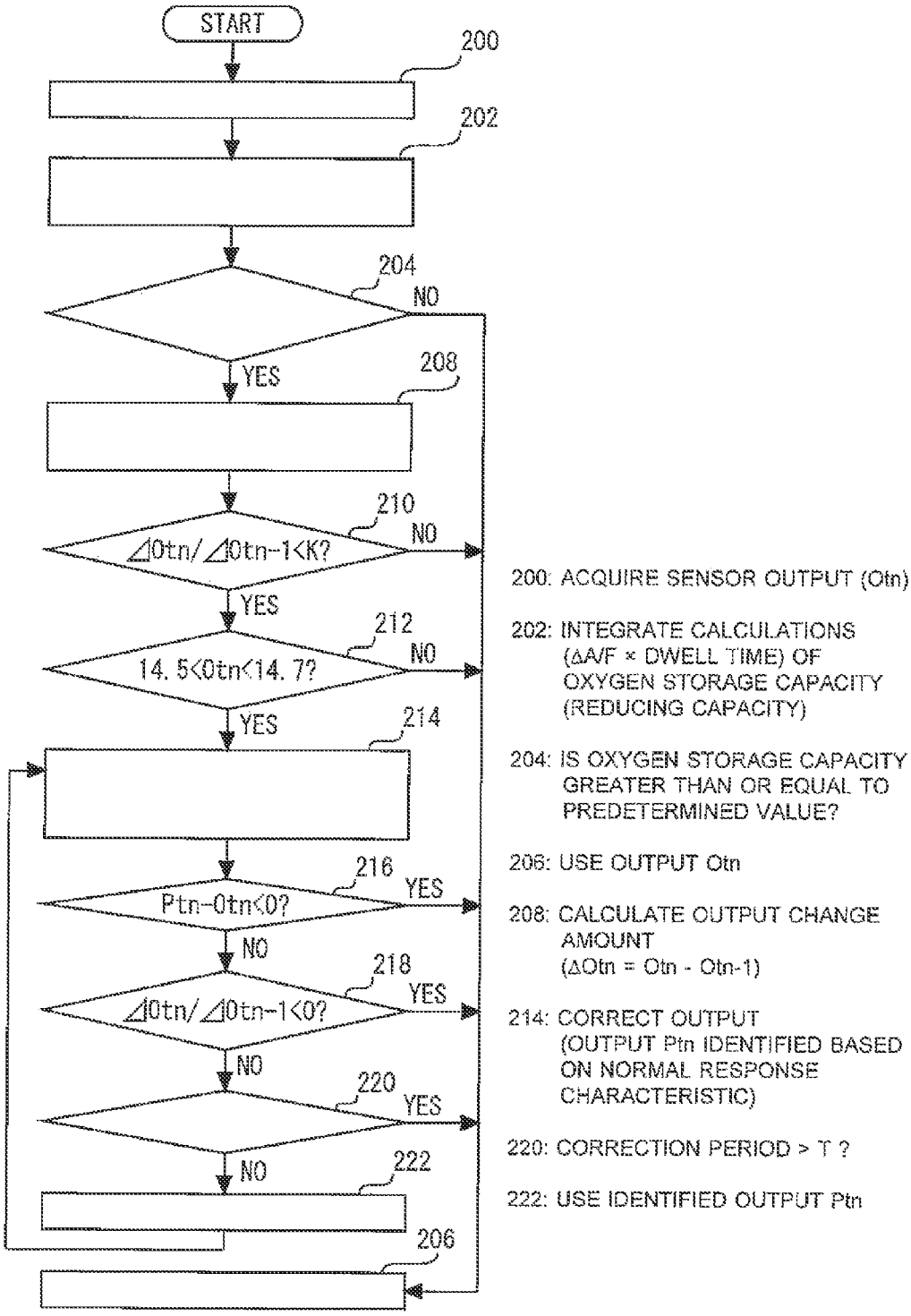
FIG. 7 is a flowchart of a routine that the ECU executes according to Embodiment 2.

Therefore, according to the system of Embodiment 2, a configuration is adopted that, utilizing the tendency shown in FIG. 6, sets a correction period so as to increase as the integrated value of $\Delta A/F\times$dwell time increases, in other words, as the oxygen storage capacity increases. Since it is thereby possible to appropriately set the timing for ending correction, a situation in which unnecessary correction is continued can be effectively avoided.

[Specific Processing in Embodiment 2]

Next, specific processing of Embodiment 2 of the present invention is described with reference to FIG. 7. FIG. 7 is a flowchart of a routine that the ECU 30 executes according to Embodiment 2. In steps 200 to 214 in the routine shown in FIG. 7, processing that is the same as in the above described steps 100 to 114 is executed. In step 214, after the sensor output is corrected to the identified output Ptn, the ECU 30 then determines whether or not the sensor output Otn tracked the identified output Ptn (step 216). In this case, specifically, the ECU 30 determines whether or not a value obtained by subtracting the sensor output Otn from the identified output Ptn is less than 0 (zero). If it is determined as a result that a condition $Ptn-Otn<0$ is established, the ECU 30 determines that the sensor output Otn tracked the identified output Ptn and moves to the aforementioned step 206 to use the sensor output Otn as the true air-fuel ratio.

In contrast, in the aforementioned step 216, if it is determined that the condition $Ptn-Otn<0$ is not established, the ECU 30 determines that the sensor output Otn is not yet tracking the identified output Ptn, and therefore moves to the next step to determine whether or not the sensor output has turned from a change to the rich side to a change to the lean side (step 218). Specifically, here, the ECU 30 executes the same processing as in the aforementioned step 116. If it is determined as a result that the condition $\Delta Otn/\Delta Otn-1<0$ is established, since it indicates that the sensor output has begun to change towards the lean side in the vicinity of the stoichiometric ratio, the ECU 30 determines that correction of the sensor output should be ended. Therefore, the ECU 30 moves to the aforementioned step 206 to use the sensor output Otn as the true air-fuel ratio instead of the identified output Ptn.

In contrast, in the aforementioned step 218, if it is determined that the condition $\Delta Otn/\Delta Otn-1<0$ is not established, the ECU 30 moves to the next step and determines whether or not the correction period has exceeded an output stagnation time period T (step 220). Here, specifically, first the output stagnation time period T is set based on the oxygen storage capacity that was calculated in the aforementioned step 202. More specifically, in accordance with the relationship illustrated in FIG. 6, the higher that the oxygen storage capacity is, the larger the value that the output stagnation time period T is set to. Subsequently, the ECU 30 determines whether or not a correction period from a time that the correction operation with respect to the sensor output in the aforementioned step 214 started exceeds the output stagnation time period T. If it is determined as a result that a condition correction period>output stagnation time period T is established, the ECU 30 determines that stagnation of the sensor output has ended, and moves to the aforementioned step 206 to use the sensor output Otn as the true air-fuel ratio instead of the identified output Ptn. In contrast, in the aforementioned step 220, if it is determined that the condition correction period>output stagnation time period T is not established, the ECU 30 determines that the sensor output is still stagnating in the vicinity of the stoichiometric ratio. Therefore the ECU 30 moves to the next step in which the identified output Ptn is used as the corrected air-fuel ratio (step 222).

As described above, according to the system of Embodiment 2, since the output, stagnation time period T is set based on the oxygen storage capacity, a stagnation time period of the sensor output can be accurately ascertained and a timing at which to end correction of the sensor output can be appropriately determined.

In this connection, although in the above described Embodiment 2 a configuration is adopted in which the output stagnation time period T is set based on the oxygen storage capacity, the actual output stagnation time period is a short period of the extent of an amount of time in which the air-fuel ratio deviates from the stoichiometric ratio while the sensor output is stagnating. Therefore, for example, by adding a deviation amount from the stoichiometric ratio of the air-fuel ratio during a period in which the output is stagnating as a parameter when setting the output stagnation time period T, the output stagnation time period can be set with even greater accuracy.

In addition, although in the above described Embodiment 2 an example is described of a case where the air-fuel ratio of exhaust gas straddles the stoichiometric ratio to change from lean to rich, in a case where, conversely, the air-fuel ratio straddles the stoichiometric ratio to change from rich to lean, control can be executed in a similar manner by interchanging the terms "lean" and "rich" with each other in the above description.

Note that, in the above described Embodiment 2, a target temperature of the sensor element 34 during a period of executing a correction operation may be increased to a higher temperature than a normal target temperature. That is, as described above, stagnation of the sensor output in the vicinity of the stoichiometric ratio is an output characteristic that arises due to oxygen stored in the catalyst layer 38 reacting with exhaust gas under a lean atmosphere. Therefore, if a configuration is adopted in which the target temperature of the sensor element 34 is raised during a stagnation time period of the sensor output to thereby enhance the sensor activity, since the oxygen storage capacity (reducing capacity) in the catalyst layer 38 can be effectively raised, recovery from stagnation of the sensor output at an early stage is enabled. Note that, in the case of executing the aforementioned control, it is preferable to take into account an amount by which the output stagnation time period is shortened as the result of increasing the target temperature of the sensor element 34 when setting the output stagnation time period T.

Note that, in the above described Embodiment 2, "oxygen storage capacity acquisition, means" according to the first invention is realized by the ECU 30 executing the processing in the aforementioned step 202, and "correction means" according to the first invention is realized by the ECU 30 executing the processing in the aforementioned step 214.

In addition, in the above described Embodiment 2, "sensor output rate-of-change acquisition means" according to the third invention is realized by the ECU 30 executing the processing in the aforementioned step 208, and "correction means" according to the third invention is realized by the ECU 30 executing the processing in the aforementioned step 214.

Further, in the above described Embodiment 2, "setting means" according to the fourth invention is realized by the ECU 30 executing the processing in the aforementioned step 220.

Furthermore, in the above described Embodiment 2, "heating control means" according to the fourth invention is realized by the ECU 30 executing the processing in the aforementioned step 214.

Embodiment 3

[Features of Embodiment 3]

Figure 8:
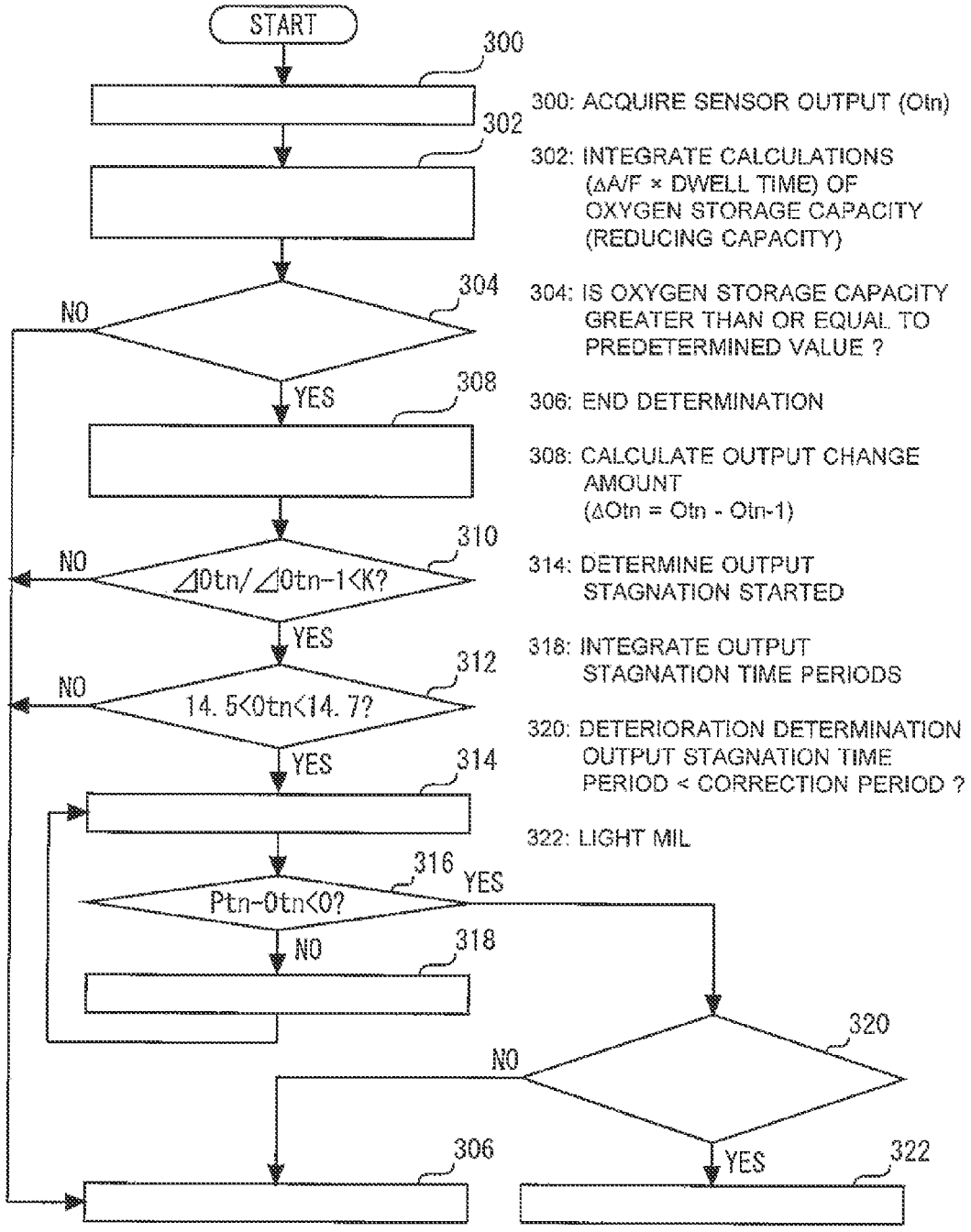
FIG. 8 is a flowchart of a routine that the ECU executes according to Embodiment 3.

Next, Embodiment 3 of the present invention is described with reference to FIG. 8. The system of the present embodiment can be implemented using the hardware configuration shown in FIG. 1 by causing the ECU 30 to execute a routine that is shown in FIG. 8 that is described later.

As described above, stagnation of the sensor output in the vicinity of the stoichiometric ratio is an output characteristic that arises due to oxygen stored in the catalyst layer 38 reacting with exhaust gas under a lean atmosphere. Consequently, in a case where a difference arises between the output stagnation time period T that is set based on the calculated oxygen storage capacity, and an actual output stagnation time period, there is a high possibility that deterioration of the catalyst layer 38 is progressing.

Therefore, according to Embodiment 3, a configuration, is adopted in which existence/non-existence of deterioration of the catalyst layer 38 is determined by comparing the calculated output stagnation time period T and the actual output stagnation time period. Hereunder, specific processing for determining the existence/non-existence of deterioration of the catalyst layer 38 of the air-fuel ratio sensor 22 is described in accordance with a flowchart.

[Specific Processing in Embodiment 3]

FIG. 8 is a flowchart of a routine that the ECU 30 executes according to Embodiment 3. According to the routine shown in FIG. 8, first, the ECU 30 acquires the sensor output Otn (air-fuel ratio) of the air-fuel ratio sensor 22 (step 300). Next, the ECU 30 calculates the oxygen storage capacity of the catalyst layer 38 (step 302). Thereafter, the ECU 30 determines whether or not the oxygen storage capacity is greater than or equal to a predetermined value (step 304). In this case, specifically, processing that is the same as in the above described steps 100 to 104 is executed. If it is determined as a result that a condition that the oxygen storage capacity≥predetermined value is not established, the ECU 30 determines that stagnation of the sensor output does not occur even if the sensor output is in the vicinity of the stoichiometric ratio, and moves to the next step to end the processing to determine deterioration of the catalyst layer 38 (step 306).

In contrast, if it is determined in the aforementioned step 304 that the condition that the oxygen storage capacity≥predetermined value is established, the ECU 30 determines that oxygen of a level such that stagnation of the sensor output occurs is stored in the catalyst layer 38, and moves to the next step to calculate the output change amount ΔOtn (=Otn−Otn−1) in a predetermined period of the sensor output (step 308). Next, the ECU 30 determines whether or not (ΔOtn/ΔOtn−1) that shows a change ratio of the output change amount ΔOtn is smaller than a predetermined value K (step 310). Here, processing that is the same as in the above described step 108 is executed. If it is determined as a result that the condition (ΔOtn/ΔOtn−1)<K is not established, the ECU 30 determines that a change in the sensor output has not yet become slow, and moves to the aforementioned step 306 to end the processing to determine deterioration of the catalyst layer 38.

In contrast, in the aforementioned step 310, if it is determined that the condition (ΔOtn/ΔOtn−1)<K is established, the ECU 30 determines that a change in the sensor output has become slow, and moves to the next step to determine whether or not the sensor output Otn is an air-fuel ratio in the vicinity of the stoichiometric ratio (step 312). Here, specifically, processing that is the same as in the above described step 108 is executed. If it is determined as a result that a condition 14.5<Otn<14.7 is not established, the ECU 30 determines that the air-fuel ratio is not in a region in which stagnation of the sensor output arises, and moves to the aforementioned step 306 to end the processing to determine deterioration of the catalyst layer 38.

In contrast, in the aforementioned step 312, if it is determined that the condition 14.5<Otn<14.7 is established, the ECU 30 determines that stagnation of the sensor output in the vicinity of the stoichiometric ratio is occurring, and moves to the next step in which the ECU 30 determines that output stagnation has started (step 314). Next, the ECU 30-determines whether or not the sensor output Otn tracked the identified output Ptn (step 316). Here, specifically, processing that is the same as in the above described step 216 is executed. If it is determined as a result that the condition Ptn−Otn<0 is not established, the ECU 30 determines that stagnation of the sensor output is still continuing, and moves to the next step in which the output stagnation time period is integrated (step 318). In this case, specifically, the output stagnation time period after integration is stored as an actual measured value of the output stagnation time period, and thereafter the ECU 30 again moves to the aforementioned step 314.

In contrast, in the aforementioned step 316, if it is determined that the condition Ptn−Otn<0 is established, the ECU 30 determines that the sensor output Otn tracked the identified output Ptn, that is, the ECU 30 determines that stagnation of the sensor output ended. Thereafter, the ECU 30 moves to the next step to determine deterioration of the catalyst layer 38 (step 320). Here, specifically, the ECU 30 first calculates the output stagnation time period T based on the oxygen storage capacity calculated in the aforementioned step 302. More specifically, in accordance with the relationship shown in FIG. 6, the higher that the oxygen storage capacity is, the larger the value that the output stagnation time period T is calculated as. Subsequently, the ECU 30 determines whether or not the relevant output stagnation time period T is larger than the actual measured value of the output stagnation time period that was stored in the aforementioned step 318. If it is determined as a result that the output stagnation time period T exceeds the actual measured value, the ECU 30 determines that the actual oxygen storage capacity is lower than the oxygen storage capacity that is calculated based on the air-fuel ratio and the dwell time thereof, and moves to the next step. In the next step (step 322), an MIL is lit to notify the operator of the vehicle or the like that the catalyst layer 38 has deteriorated. In contrast, in the aforementioned step 320, if the output stagnation time period T does not exceed the actual measured value, it is determined that the catalyst layer 38 has not deteriorated, and the ECU moves to the aforementioned step 306 to end the processing to determine deterioration of the catalyst layer 38.

As described in the foregoing, according to the system of Embodiment 3, deterioration of the catalyst layer 38 of the air-fuel ratio sensor 22 can be effectively determined by utilizing a characteristic of the sensor output that arises under a specific condition.

In this connection, although in the above described Embodiment 3 an example is described of a case where the air-fuel ratio of exhaust gas straddles the stoichiometric ratio to change from lean to rich, in a case where, conversely, the air-fuel ratio straddles the stoichiometric ratio to change from rich to lean, control can be executed in a similar manner by interchanging the terms "lean" and "rich" with each other in the above description.

Note that, in the above described Embodiment 3, "output stagnation time period acquisition means" according to the above described sixth invention is realized by the ECU 30 executing the processing in the aforementioned step 318, and "setting means" and "deterioration determination means" according to the sixth invention are respectively realised by the ECU 30 executing the processing in the aforementioned step 320.

DESCRIPTION OF REFERENCE CHARACTERS

10 internal combustion engine
12 intake passage
14 exhaust passage
16 air flow meter
18 injector
20 exhaust purification catalyst
22 air-fuel ratio sensor
30 ECU (Electronic Control Unit)
32 cover
34 sensor element
36 diffusion resistance layer
38 catalyst layer
40 protective layer
42 exhaust gas-side electrode
44 solid electrolyte layer
46 atmosphere-side electrode
48 atmospheric chamber
50 heater

The invention claimed is:

1. A control device for an internal combustion engine, comprising:

an exhaust gas sensor configured to be arranged in an exhaust passage of an internal combustion engine, and includes a sensor element comprising a solid electrolyte in which an atmosphere-side electrode is formed on one side surface and an exhaust gas-side electrode is formed on another side surface, and a catalyst layer that covers the exhaust gas-side electrode; and an electronic control unit having control logic, which when executed:

acquires an oxygen storage capacity that represents a capacity of the catalyst layer to store or release oxygen based on a sensor output of the exhaust gas sensor; and executes a correction operation that corrects the sensor output when the oxygen storage capacity is higher than a predetermined value and the sensor output is in a predetermined range in a vicinity of a theoretical air-fuel ratio.

2. The control device for an internal combustion engine according to claim 1, wherein, as the oxygen storage capacity, the electronic control unit acquires a value obtained by integrating a product of a deviation amount of the sensor output with respect to a theoretical air-fuel ratio and a dwell time thereof.

3. The control device for an internal combustion engine according to claim 1, wherein the electronic control unit has control logic, which when executed:

acquires a rate of change of the sensor output, and executes the correction operation when (i) the oxygen storage capacity is higher than a predetermined value, (ii) the sensor output is in a predetermined range in a vicinity of a theoretical air-fuel ratio, and (iii) a rate of change in the sensor output is less than a predetermined value.

4. The control device for an internal combustion engine according to claim 1, wherein the electronic control unit has control logic, which when executed sets a correction period in which the correction operation is performed, in accordance with the oxygen storage capacity.

5. The control device for an internal combustion engine according to claim 1, further comprising:

a heater for heating the sensor element to a predetermined activation temperature; and wherein the electronic control unit has control logic, which when executed controls the heater during the correction operation so that the sensor element becomes a higher temperature than the predetermined activation temperature.

6. The control device for an internal combustion engine according claim 1, wherein the electronic control unit has control logic, which when executed:

sets a correction period in which the correction operation is performed, in accordance with the oxygen storage capacity;

acquires an output stagnation time period from a time that the correction operation starts until a time that the sensor output tracks an actual air-fuel ratio change; and when the correction period is longer than the output stagnation time period, determines that there is deterioration of the catalyst layer in the exhaust gas sensor.

* * * * *